United States Patent [19]

Reimers

[11] Patent Number: 4,778,136

[45] **Date of Patent: * Oct. 18, 1988**

[54] GOLF BAG WITH INTEGRAL STAND

[76] Inventor: Eric W. Reimers, 235 N. First St., Missoula, Mont. 59802

[ * ] Notice: The portion of the term of this patent subsequent to Jun. 30, 2004 has been disclaimed.

[21] Appl. No.: 13,647

[22] Filed: Feb. 12, 1987

[51] Int. Cl.[4] ..... A63B 55/00

[52] U.S. Cl. ..... 248/96; 206/315.5; 206/315.7

[58] Field of Search ..... 248/96, 95, 97, 169, 248/168, 167, 170, 171; 206/315.3, 315.5, 315.6, 315.7, 315.8

[56] References Cited

U.S. PATENT DOCUMENTS

| | | | |
|---|---|---|---|
| 1,791,188 | 2/1931 | Bright | 248/96 |
| 1,895,366 | 1/1933 | Beard | 248/96 |
| 1,975,702 | 10/1934 | Sterling | 248/96 |
| 2,571,088 | 10/1951 | Walton | 248/96 |
| 2,663,528 | 12/1953 | Hadley | 248/96 |
| 2,676,737 | 4/1954 | Zirbel | 206/315.3 |
| 2,749,069 | 6/1956 | Sandstrom | 248/96 |
| 2,768,668 | 10/1956 | Santosuosso | 248/96 |
| 3,432,130 | 3/1969 | Breedlove et al. | 248/96 |
| 3,435,866 | 4/1969 | Cantwell | 248/96 X |
| 3,787,017 | 1/1974 | Sauer | 248/96 |
| 4,054,256 | 10/1977 | Buck et al. | 248/96 |
| 4,226,389 | 10/1980 | Neth | 248/96 |
| 4,266,589 | 5/1981 | Cochran | 206/315.5 |
| 4,453,686 | 6/1984 | Ina | 248/168 |
| 4,506,854 | 3/1985 | Kim | 248/96 |
| 4,600,100 | 7/1986 | Solheim | 206/315.3 X |
| 4,620,682 | 11/1986 | Yim | 248/96 |
| 4,676,464 | 6/1987 | Reiners | 248/96 |

*Primary Examiner*—Ramon O. Ramirez
*Attorney, Agent, or Firm*—Michael J. Hughes

[57] ABSTRACT

A golf bag with integral stand (10) that allows the bag portion (12) to rest in a semi-upright position. The bag portion (12) is supported by two support members (38 and 40). The positioning of the support members (38 and 40) is controlled by a series of three webbings (56, 64, and 70) in conjunction with the bag strap (34) and elasticized shock cords (51 and 52). Forces applied to the bag strap (34) are transmitted to the support members (38 and 40) via the webbings (56, 64, and 70). When pressure on the bag strap (34) is released, the shock cords (51 and 52) urge the support legs (38 and 40) away from the bag portion (12) toward their stand position. The support member (38 and 40) are removably attached to the bag portion (12) by means of a support member housing (42). The support member housing (42) is attached to the reinforcing spine (18). The golf bag device (10) will be of great utility to all golfers who desire to carry their own clubs. The bag (10) will be marketed wherever golf equipment is sold.

20 Claims, 2 Drawing Sheets

GOLF BAG WITH INTEGRAL STAND

TECHNICAL FIELD

The present invention relates generally to sporting goods and more specifically to golfing equipment.

BACKGROUND ART

Golf is a game that has been popular in many parts of the world for many generations. Part of the game's popularity is due to the fact that it is one of of the few "life sports". That is, complete retirement because of age is rarely necessary. Golf provides an excellent vehicle for reasonable exercise for an extremely wide range of people.

The nature of the game requires that a substantial amount of equipment (e.g. clubs) be carried with the golfer as he moves about the course. There are several methods available to accomplish this, among them being the power cart, the hand-pulled cart, and the hiring of a caddy. However, the golfing purist or the person wishing to maximize the amount of exercise obtained from a round of golf will carry his or her own clubs. Carrying additional weight while exercising will clearly increase the strain on the cardiovascular and and muscular systems. This increased strain, within healthful limits, is exactly the desired product of exercise.

One problem inherent in carrying one's own golf bag is that the bag and equipment can be somewhat awkward. This awkwardness manifests itself not only in the carrying but also in finding something to do with the bag while making a shot. Minimal experience will teach a golfer that simply tossing the bag on the ground may cause soiling of the bag and may also provide more exercise in the nature of club retrieving activity than is desired. Helpful trees and other surfaces to prop the bag against are not always available and are notoriously fickle as well, often leading to tipping over and other problems, such as tree sap on the bag material. Backstrain from bending to the ground to pick out clubs and to lift the bag is a common result.

To combat these problems, inventive golfers, who are notorious for their willingness to try anything, have created a multitude of prior art devices to keep the bag in a semi-upright position. Theses devices can be grouped very generally into four categories.

The first type of device is an independent support. These devices are designed to be "added on" to the golf bag. An early example of this type of device is Arthur Smith's "Golf-Bag Holder", U.S. Pat. No. 1,475,605 dated May 27, 1922. A somewhat more recent example is Warren R. Tolman's "Collapsible Stand for Golf Bags", U.S. Pat. No. 2,902,238, dated Feb. 4, 1958. These examples of the prior art have the disadvantage of including support elements which are fixed in place. They therefore add to the effective volume of the bag, making it even more difficult to maneuver in close areas and limiting the comfortable carrying and storage orientations.

Another category of prior art contains devices designed to hold the bag upright by means of a sharpened stake adapted to be driven into the ground. Examples of this type of support appeared as early as Elmer T. Pocklington's "Device for Supporting Golf Bags", U.S. Pat. No. 1,548,169, issued Nov. 5, 1924. Devices of this nature appear periodically from that date to June 30, 1976, the issue date of the Panetta device, "Attachments for Golf Bags", U.S. Pat. No. 4,071,062. These devices have serious disadvantages in that a golfer may need to stand his or her bag in rocky ground or, perish the thought, sand. Also, the fact that many of the stakes in these devices are not retractable could present somewhat of a safety hazard to the golfer and others. Given the frequently volatile nature of the game, it is not always desirable to have sharp objects readily at hand.

The most common type of device in the prior art seems to be a straightforward tripod arrangement. The standard device of this type consists of two rigid support members attached to the bag, generally hinged for retraction, with the third leg of the tripod being the golf bag itself. The devices are myriad, an early example being George Parnall's "Stand for Golf Caddie-Bags and the Like", U.S. Pat. No. 1,135,464, dated June 18, 1914. A more recent device is that of Elwood Buck Jr. et al, "Support for a Golf Bag", U.S. Pat. No. 4,054,256, dated Aug. 18, 1976. The major disadvantage of these devices is that the golfer has to somehow engage the device every time the bag is set down, and disengage the device when the bag is picked up.

An effort to alleviate this problem can be seen in the fourth category of prior art, really a subset of the tripod category. The devices in this category all have some means to "automatically" engage the device. Some of these devices are spring-loaded, an early example being Henry Henneberg's "Golf-Caddie-Bag Stand", U.S. Pat. No. 1,187,007, dated Nov. 1, 1915. This device makes use of a "spring pressed sleeve" that, when released, pushes the support legs into proper position. Other devices make some use of gravity in their operation. Murray D. Gallagher's "Golf Bag", U.S. Pat. No. 1,840,663, dated Feb. 24, 1930, is one such device. Francis Leigh Cox's "Stand for Golf Bags", U.S. Pat. No. 2,305,517, dated Sept. 8, 1941, is another. Both of these devices have the disadvantage of requiring a latching mechanism to secure the support legs when they are not in use. Also, the Gallagher device requires considerable extra hardware.

In sum, the prior art generally suffers from one or more of three major disadvantages, among others. The primary disadvantages are: (1) The device for support is not integrated into the golf bag; (2) too much additional hardware is necessary, increasing the weight and effective volume; or (3) the device requires manual engagement and/or retraction.

DISCLOSURE OF INVENTION

Accordingly, it is an object of the present invention to provide a method of supporting a golf bag in a semi-upright position, the means of support being integrated into the structure of the golf bag itself.

It is another object of the present invention to provide a device that does not require the addition of bulky or heavy additional elements to the basic golf bag structure.

It is a further object of the prsent invention to provide a device that does not add significantly to the effective volume of the golf bag, such that bag storage is not made more difficult.

It is still another object of the invention to provide a stand mechanism which retracts to such a degree that in carry mode there is no interference with the golfer's body.

It is another object of the present invention to provide a bag that is well balanced and streamlined enough so that it can be picked up and lowered with one hand.

Briefly the preferred embodiment of the present invention is a golf bag with integral stand. The invention is related to and an improvement on the inventor's prior inventions which are disclosed in applications presently pending in the United States Patent and Trademark Office. Theses inventions are entitled "GOLF BAG WITH INTEGRAL STAND", Ser. No. 783,769, now U.S. Pat. No. 4,676,464 and "GOLF BAG DEVICE", Ser. No. 783,767, now U.S. Pat. No. 4,685,561 and are copending herewith. The bag portion itself has a generally triangular cross-section with rounded corners. It is closed at one end by a rigid base plate. In the preferred version the bag is formed to stand at an angle, and a directly vertical position is inhibited. The top end, situated opposite the base plate, is open, with a cross-membered collar to provide compartments to separate the clubs.

Attached to the bag is a sling or bag strap which is used to carry the bag and also controls the positioning of the support members. One end of the bag strap is attached to the collar by means of a nylon strap. The other end is attached to the support members. The mid-section of the bag strap is padded for extra comfort when the bag rests on the golfer's shoulder.

Further aid in extending the support members is accomplished by means of elasticized shockcords. One end of the shockcords is attached to the upper area of the bag. The other end is removably attached to the support members. The shock cords cause the support members to be urged into stand mode position when no force is applied via the bag strap. They can be detached when storing or transporting the bag so that no undesired force is applied to the support members.

An advantage of the present invention is that the structure providing support is integrated into the structure of the bag.

A further advantage of the present invention is that the simplicity of design results in very few additions being necessary to the basic bag construction.

Another advantage of the present invention is that there are minimal projections from the body of the bag, hence the effective volume and weight of the bag are not significantly increased.

Still another advantage of the present invention is that it is fully self-actuating in normal use, thereby providing maximum convenience to the golfer.

Another advantage of the present invention is that the independent modular structure of the support members and shockcords allows them to be easily replaced if they are broken.

A further advantage of the present invention is that it can be operated in a "one-handed" fashion.

These and other objects and advantages of the present invention will become clear to those skilled in the art in veiw of the best presently known mode of carrying out the invention and the industrial applicability of the preferred embodiment as described herein and as illustrated in the several figures of the drawing.

BEST MODE OF CARRYING OUT THE INVENTION

Figure 2:
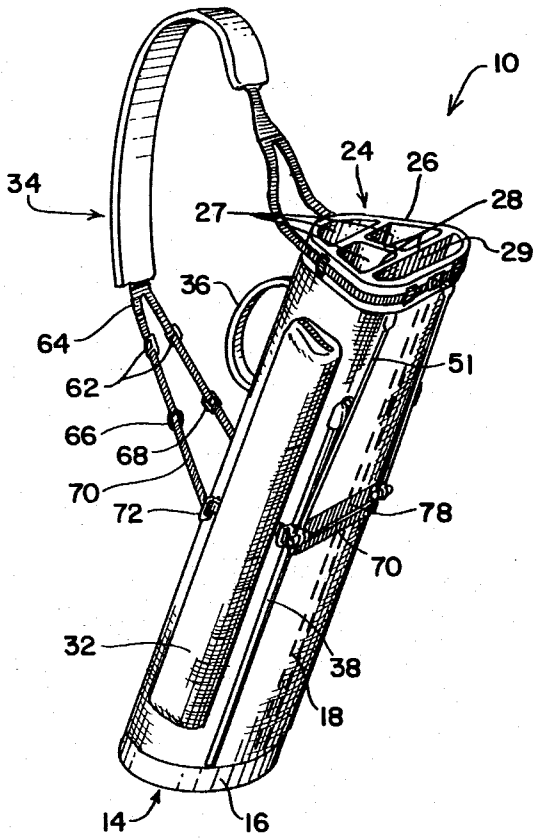
FIG. 2 is a perspective view of the invention, shown in the carry mode.

The present invention is a golf bag with integral stand, directed at providing a golf club carrying apparatus that will remain in a semi-upright position (stand mode) while the golfer is making a shot or resting and assume a compact comfortable form (carry mode) when being transported by its bag strap. The preferred embodiment of the invention is illustrated in the drawing and described herein.

Figure 1:
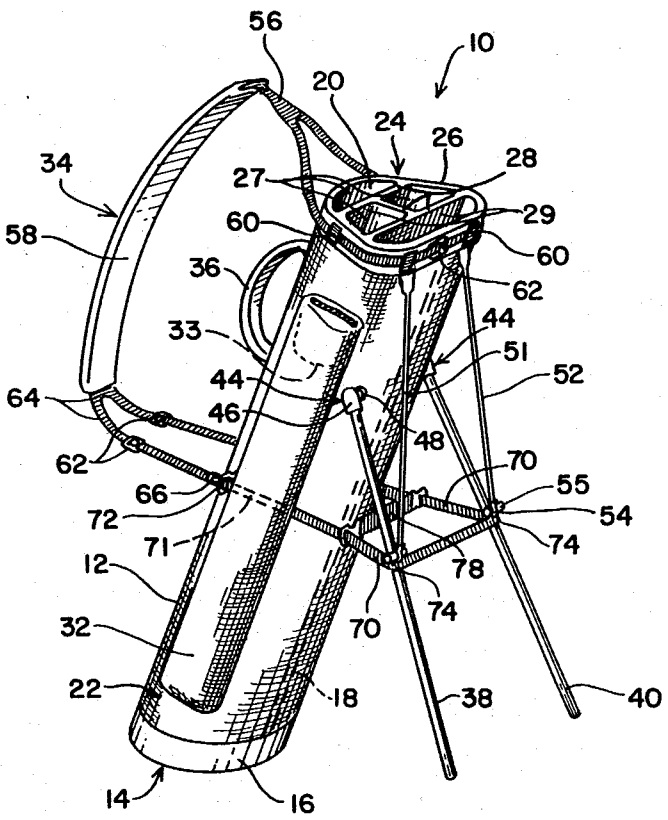
FIG. 1 is a perspective view of a golf bag with integral stand according to the preferred embodiment of the present invention, shown in the stand mode.

Referring to FIG. 1, the preferred embodiment of the golf bag is shown in a perspective view in the position it would assume while at rest, referred to as the "rest" or "stand" mode. The golf bag with integral stand of the present invention is referred to by the general reference character 10.

The major component of the invention 10 is a bag portion 12, generally describable as a diagonally cut cylindrical member having a rounded triangular transverse cross-section and being closed at one end. An axial cross-section of the bag portion 12 yields a parallelogram having a rear base angle of approximately 67°. A closed end 14 (usually referred to as a "bottom") is covered by a rigid base plate 16. In the preferred embodiment, a reinforcing spine 18 extends the entire length of the bag portion 12 along the front edge to provide added rigidity. A semi-rigid enclosing casing 20 is provided to create an enclosed volume. The semi-rigidity of the casing 20 is for the purpose of maintaining integrity of shape and protecting the contents of the bag portion 12. The casing 20 is covered by a fabric outer covering 22 for appearance and attachment of pockets. At an open end 20 of the bag portion 12 is a rigid collar 26. The collar 26 is divided into a plurality of slots 27 by multiple cross members 28 so that the bag portion 12 is compartmentalized. The cross members 28 are integral to the collar 26. The orientation of the cross members 28 is not crucial, as their function is merely to divide the bag portion 12 into the slots 27 for ready separation of clubs and to provide improved balance. In order to provide full length compartments, fabric dividers 29 extend from the horizontal cross members 28 for the full length of the bag portion 12. The bag portion 12 is thus divided into three full length compartments.

Figure 3:
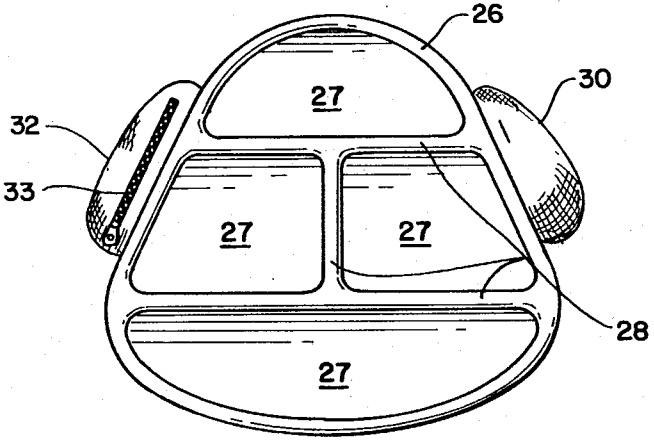
FIG. 3 is a top plan view of the bag portion of the preferred embodiment.

Attached to the exterior of the outer covering 22 are a small storage pouch 30 and a full length storage pouch 32. The pouches 30 and 32 are teardrop shaped in lateral cross-section as can be more readily seen in FIG. 3. The small pouch 30 is located on the right (when viewed from the front in the stand mode) side of the bag portion 12 near the closed end 14. The small pouch 30 is typically filled with golf balls. Accordingly, the small pouch 30 extends less than halfway up the length of the bag portion 12 so as not to contact the golfer when he is carrying the bag 10. This minimizes discomfort. The full length pouch 32, typically for enclosing larger items, is on the left side. The full length pouch includes a tee pocket 33 at its upper end for enclosing small items such as tees and ball markers. Both pouches 30 and 32 are accessed by zippered openings.

The bag 10 may be carried by means of either a golf bag strap 34 or a handle 36. Use of the bag strap 34 automatically causes the bag 10 to assume carry mode position (FIG. 2) while carrying the bag 10 by the handle 36 will ordinarily leave the bag in stand mode (FIG. 1). The handle 36 is attached along the rear (diametrically opposite the reinforcing spine), near the top, of the bag portion 12. It is envisioned that the bag 10 will ordinarily be carried by the strap 34 when the bag 10 is in use, but the handle 36 is provided to facilitate one hand lifting, as e.g. when taking the bag 10 from the trunk of one's car, or when one wishes to transport the bag 10 a short distance without an actual shoulder carry.

Figure 5:
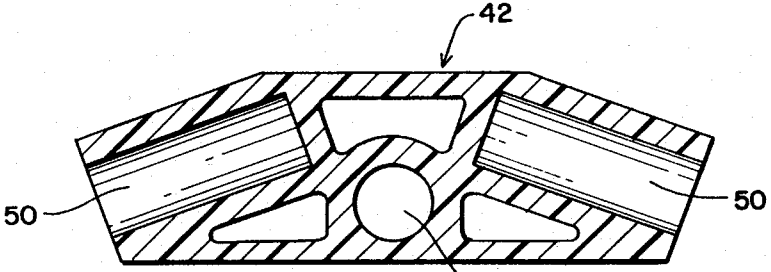
FIG. 5 is a perspective view of the support member housing.

The elements that cause the bag 10 to remain in the stand mode include a left support member 38 and a right support member 40. The support members 38 and 40 (also known as legs) are attached to the bag 10 by means of a support member housing 42. The housing is best shown in FIG. 5. The housing 42 is affixed to the reinforcing spine 18 approximately 25.4 cm (10.0 in) from the top of the collar 26. A hole 43 is drilled in the block in the vertical plane so that the housing 42 fits over the reinforcing spine 18. The housing 42 is then fastened securely to the spine 18 by conventional techniques such as adhesives or mechanical fasteners so that the housing 42 cannot slide along the spine 18.

Figure 4:
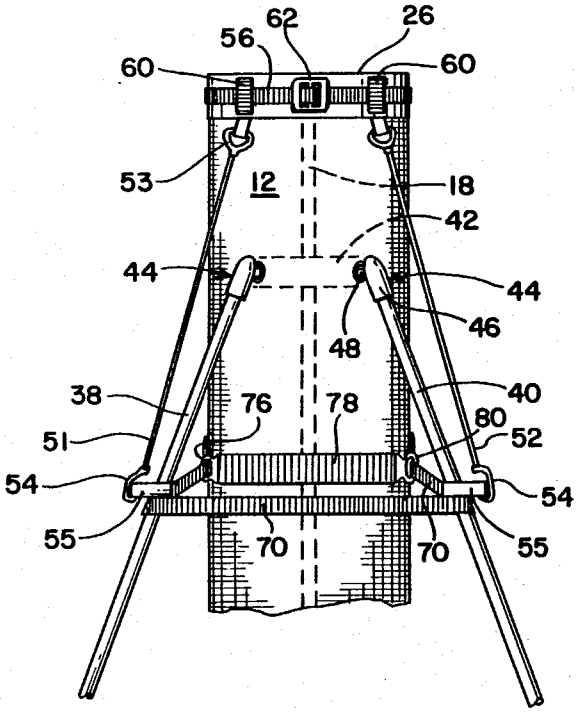
FIG. 4 is a front elevational view of the upper area of the bag portion.

The structure of the legs 38 and 40 and the motive elements present on the front surface of the bag 10 is best understood with reference to FIG. 4. Each support member 38 and 40 includes elbows 44 adapted for providing a pivotal mating with the housing 42. The elbows 44 have a cap portion 46 which fits over the upper end of the support members 38 and 40, and a pivot axle 48. The elbows 44 are pivotally inserted into the housing 42 by means of two apertures 50 that are provided in the housing 42. The apertures 50 are angled toward the rear of the bag 10. The angling is required so that although the support members 38 and 40 are flush to the bag portion 12 while in carry mode, (FIG. 2), the lower ends of the support members 38 and 40 spread when the bag 10 is in the stand mode, (FIG. 1). This creates a support base that is significantly wider than the bag 10 itself. Since the support members 38 and 40 are flush to the bag portion 12 while in carry mode, there is minimal contact with the golfer's hip, side, or leg. Also, this configuration minimizes effective volume to promote effective space utilization when storing the bag 10.

No adhesive or fastening device is required or utilized to anchor the elbows 44 in the housing 42. They are held in place by elastic action only. This allows the pivot axle 48 to turn freely within the housing 42. The "plug in" characteristic also allows for easy replacement of the support members 38 and 40 should they be broken or damaged.

The positioning of the support members 38 and 40 is controlled by the interaction of gravity, a left elastic shock cord 51, a right shock cord 52, and the forces applied to the bag strap 34. The shock cords 51 and 52 are each attached at one end to anchore 53 situated on or near the collar near the top of the bag portion 12. The other end is removably connected to the support members 38 and 40 by means of hooks 54 placed in slots in the underside of posts 55. The posts 55 are cylindrical elements that are affixed to the support members 38 and 40 such that the posts 55 lie in a horizontal plane when the bag 10 is in rest mode. The configuration of the shock cords 51 and 52 provides a constant tension that, if unopposed, would tend to cause the support members 38 and 40 to swing away from the bag portion 12. If the user wishes to eliminate this tension, he simply removes the hooks 54 from the posts 55. The force of the elastic shock cords 51 and 52 also is directed centerward such that the legs 38 and 40 are urged to maximally engage the support housing 42.

The strap 34 is attached at its upper end to the collar 26. The attachment is accomplished via a first webbing 56. The first webbing 56 is anchored at its midpoint at the top of a padded portion 58 which forms the middle section of the strap 34. The padded portion 58 allows for increased comfort to a golfer's shoulder when he carries the bag 10. The first webbing 56 extends around the collar 26, and is held in place thereon by four anchor loops 60. The loops 60 are spaced equidistantly around the collar 26. The length of the first webbing 56 is adjustable. In a preferred embodiment, the adjustment means is provided by joining the free ends of the first webbing 56 with a slidable buckle 62.

The attachment of the lower end of the strap 34 is a key to the positioning of the support members 38 and 40. A second webbing 64 is anchored at its midpoint to the bottom of the padded portion 58. The free ends of the second webbing 64 are looped through a left connecting element 66 and a right connecting element 68. The loops thus formed are then adjustably fixed in place and maintained in loop form. Again, one method of accomplishing this is through the use of slidable buckles 62 encompassing the free end and an interior portion of the webbing. The connection to the support members 38 and 40 is then completed through the use of a third webbing 70.

The interconnection and interaction of the strap 34, the second and third webbings 64 and 70, and the support members 38 and 40 is best understood by tracing a counter-clockwise path around the bag 10, beginning at the lower end of the padded portion 58 of the strap 34. It is at that point that the second webbing 64 is anchored to the padded portion, typically by direct stitching. The left free end of the second webbing 64 is looped around one side of the left connecting element 66. Also attached to the left connecting element 66 is the left free end of the third webbing 70. This attachment is accomplished by a loop that is fixedly attached to itself such that a nonadjustable closed loop is formed to attach the left connector 66 to the end of third webbing 70. The loop also encloses a left eyelet 72. The third webbing 70 passes through a channel 71 situated behind the full length pouch 32, through a left D-ring 76 of a centering strap 78, and around the left support member 38. The third webbing 70 then continues around the right support member 40, through a right D-ring 80, also attached to the centering strap 78, and is looped around the right connecting element 68, and a right eyelet 82 corresponding to the left eyelet 72.

The attachment to the suport members 38 and 40 is made more secure by "pinching" the third webbing 70 together immediately behind the support members 38 and 40 to form tighter loops around the legs. Thus, contact points 74 are formed between the sections of the third webbing 70 that extend from the bag portion 12 and that section of the third webbing 70 that passes between the two support members 38 and 40. The contact points 74 are anchored by one or more rows of stitching. This forms a fixed loop around each of the support members 38 and 40.

After passing around the support members 38 and 40, the right free end of the third webbing 70 passes around the bag portion 12, and is looped around a corresponding right eyelet 82 and the right connecting element 68.

Note that the loops in the ends of the third webbing 70 must be sufficiently large to allow for the horizontal travel distance that the third webbing 70 must move to position the support members 38 and 40. That is, the fixed positions of the support members 38 and 40 are reached when the top or the bottom of the loops in the third webbing 70 contact the eyelets 72 and 82. The distance is approximately 15.2 cm (6.0 in.) in the preferred embodiment. Also attached to the right connecting element 68 is the right free end of the second webbing 64. Thus, a complete circuit of webbing is formed that connects the lower end of the bag strap 34 with the support members 38 and 40. This circuit controls the positioning of the support members 38 and 40 when the bag 10 is in use.

When the bag 10 is in the carry mode (FIG. 2), the support members 38 and 40 are pulled against the bag portion 12. This makes the effective exterior volume of the bag 10 no more than that of an ordinary golf bag. The support members 38 and 40 are kept from being pulled farther around the bag 10 by the centering strap 78. The centering strap 78 holds the support members 38 and 40 at a fixed position while in carry mode by not allowing the support members 38 and 40 to be spread so that they would slip around the sides of the bag 10. The centering strap 78 also dissipates some of the stress that would normally fall directly on the attachment points of the support members 38 and 40. This spreading is also inhibited by the angle at which the pivot axles 48 are inserted into the support member housing 42.

When using the stand mode (FIG. 1), the bag 10 is lowered so that the rear of the base plate 16 makes the first contact with the ground. As pressure is reduced on the bag strap 34, the bag 10 will begin to tip forward. Simultaneously, gravity and the force applied by the shock cords 52 and 54 pull the lower ends of the support members 38 and 40 away from the bag portion 12. This motion is accomplishsed by the pivot axle 48 turning in the support member housing 42.

The support members 38 and 40 swing through approximately a 45° arc until the loops in the free ends of the third webbing 70 contact the eyelets 72 and 76. At that point, the motion of the support members 38 and 40 is arrested, and the bag 10 assumes the stand mode, as in FIG. 1.

When the bag 10 is lifted by its strap 34, the travel of the support members 38 and 40 is reversed. The force applied to the strap 34 is transmitted through the second and third webbings 64 and 70 to the support members 38 and 40, pulling the support members 38 and 40 toward the bag portion 12. The range of motion in this direction is limited by the bag portion 12 itself stopping the travel of the support members 38 and 40. The support members 38 and 40 are inhibited from spreading by the centering strap 78. This keeps the members 38 and 40 from sliding around the sides of the bag 10. The bag 10 then again assumes the configuration shown in FIG. 2.

As to materials, it is envisioned that in the preferred embodiment the support members 38 and 40 will be aluminum or fiberglass tubing. Clearly, nearly any rigid material would suffice. The casing 20 is formed from sturdy plastic, and the outer covering 22 is nylon. Leather or vinyl may also be used for the outer covering 22 although this substitution would have the disadvantage of incresed total weight. The base plate 16 and collar 26 are formed from rigid plastic. The webbings 56, 64, and 70 are 2.5 cm (1.0 in.) nylon strapping. The centering strap 78 is heavier gauge, 5.1 cm. (2.0 in.) nylon. The shock cords 52 and 54 are elasticized nylon.

Approximate dimensions are as follows:

The bag 10 is 86.4 cm (34.0 in.) long. Its circumference is 68.6 cm (27.0 in.). The support members 38 and 40 are 66.0 cm (26.0 in.) long. The centering strap 78 is 18.3 cm. (7.2 in.). The first webbing 56 is 91.4 cm (36.0 in.) long, the second webbing 64 is 43.2 cm (17.0 in.) long, and the third webbing 70 is 43.2 cm. (17.0 in.) long. The angle of inclination of the bag portion 12 in the rest mode is approximately 67° from horizontal. Note that the first and second webbings 56 and 64 are adjustable, and that the measurements given do not account for the material required to form the loops. Therefore, extra material beyond the above dimensions is required.

Those skilled in the art will readily observe that numerous modifications and alterations of the present device may be made while retaining the teachings of the invention. Accordingly, the above disclosure is not intended as limiting. The appended claims are therefore to be interpreted as encompassing the entire spirit and scope of the invention.

INDUSTRIAL APPLICATION

The golf bag with integral stand of the present invention will be useful to any golfer who desires to carry his or her own bag. It may persuade golfers who have previously used a cart to experiment with carrying their own bags. As mentioned before, carrying one's own bag enhances the healthful aspects of a round of golf.

The utility and applicability of the present invention is exemplified by the following discussion of typical usage. The golfer will place his or her clubs through the collar 26 into the bag portion 12 such that the club heads extend above the top of the open end 24. The clubs will ordinarily be arranged such that cross members separate the woods from the long irons and the long irons from the short irons.

Once this is accomplished the golfer will heft the bag assembly 10 by the strap 34 to carry it. The bag 10 will automatically assume the carry mode (FIG. 2) during this step. The golfer is then ready to face the course. When the first tee is reached the golfer will divest his or her shoulder of the bag assembly by setting the rear tip of the base plate 16 on the ground such that the club shafts and the reinforcing spine 18 lie in substantially vertical planes. The golfer maintains a grip on the strap 34 during this procedure. The force applied to the strap 34 is gradually decreased such that the assembly 10 leans forward until the base plate 16 is flush with the ground and the spine 18 is at an angle of approximately 20° to 30° from vertical (the stand mode of FIG. 1). This places the clubs in ideal position for inspection and removal by the standing golfer and also provides a very stable three point support to the bag, thereby preventing the assembly from tipping over.

After the shot has been made the golfer replaces the selected club in the bag portion 12 and prepares to move onward. The strap 34 is again grasped and the padded shoulder portion 58 is positioned on the golfer's shoulder. The length of the strap 34 has been previously adjusted by means of the first and second webbings 56 and 64 such that when the shoulder pad 58 is centered on the shoulder the bag assembly 10 is in the carry mode (FIG. 2) and hangs comfortably with the club shafts and the reinforcing spine 18 being offset slightly from horizontal. (Pure horizontal alignment is undesirable as the clubs have a tendency to escape the bag 12.)

When the bag assembly 10 is hefted into carry mode, the lower end of the strap 34 applies force to the second and third webbings 64 and 70 in such a manner that the support members 38 and 40 are caused to rotate backward until the rotation is arrested by the bag portion 12. The support members 38 and 40 will be held against the side of the bag portion 12. The support members 38 and 40 are held in that position so that they do not interfere with the golfer's body or unduly entangle with the environmental items which the golfer is likely to encounter while hunting for errant shots.

After the round, the assembly 10 may be easily stored in an automobile trunk in carry mode, where it is most compact, or if floor space is not at a premium, in stand mode, in a garage or storage shed. Suspension by the bag strap 34 is also feasible.

One need only survey a few pro shops, sporting goods stores or sporting goods departments of department stores to realize the widespread market for golf equipment. A device such as the present invention, which increases convenience for a golfer while maintaining his exercise level, will, in all probability, be very popular in this market.

For the above reasons, it is expected that the golf bag with integral stand of the present invention will have widespread industrial applicability. Any golfer desiring to carry his own clubs, yet wishing to have a convenient stand for his bag, will appreciate the present invention. Therefore, it is expected that the commercial utility of the present invention will be quite widespread.

I claim:

1. A golf bag device, comprising:

a bag portion suited to enclose the shaft portions of golf clubs therein;

a pair of support legs pivotally attached to the bag portion;

sling means attached to the open end of the bag, threaded through eyelets attached to the bag portion, and attached to points on each of the support legs;

wherein the device is characterized by having a carry mode in which the sling means is pulled taut and the support legs lie flat against the sides of the bag portion and a rest mode in which the sling means is slack and the support legs extend forward from the bag portion so as to form two legs of a support tripod for the device, the remaining leg of said tripod being formed by the bottom of the bag portion; and attachment of the support legs is accomplished by means of a housing device which secures the legs while allowing them to pivot freely, each in it's respective pivot plane.

2. The device of claim 1 wherein:

said housing device is attached to a reinforcing spine rod that extends the length of the bag portion.

3. The device of claim 1 wherein:

said housing device includes a pair of apertures which receive pivot axles, said pivot axles being appended to the support legs at an approximately 90° angle; and said apertures are angled such that when the device is in the carry mode the support legs lie flat against the bag portion, yet when the support legs are moved to the stand position, they pivot not only away from the bag portion but also away from each other, such that the effective area of the base of said tripod is maximized.

4. The device of claim 1 wherein said sling means includes:

a first webbing, anchored to the open end of the bag and connecting the top of a padded middle portion of the sling thereto;

a second webbing, the midpoint of which is attached to the bottom of said padded middle portion; and a third webbing which is connected to the free ends of said second webbing and completes a loop that encompasses the support legs, thereby allowing the positioning of the support legs to be controlled by forces applied to the sling means.

5. The device of claim 4 wherein:

the length of the first and second webbing is adjustable to allow each user of the device to attain a personal optimum carrying balance and to compenate for varying weight distributions of the items in the bag.

6. The device of claim 1 wherein:

the positioning of the support legs is aided by tensioning means, said means applying a force that, if unopposed, would tend to urge the support legs away from the bag portion toward the rest position.

7. The device of claim 6 wherein:

said tensioning means is a pair of elasticized shock cords.

8. The device of claim 7 wherein:

tension is achieved by attaching one end of each of said two shock cords at or near the top of the bag portion; and attaching the other ends of said shock cords to the support legs.

9. A golf bag device with integral stand, adapted to allow the bag to rest in a semi-upright position, comprising:

a bag portion including an open end and a tubular compartment in which the clubs and other equipment are stored;

a pair of support members, each being pivotally attached to a housing device secured to a reinforcing spine rod of the bag portion at a respective attachment point; and sling means adapted for carrying the bag device, the sling means being attached at one end thereof to each of the support members such that the position of the sling means controls the positions of the support members.

10. The device of claim 9 wherein:

said housing device includes apertures which receive pivot axles, said pivot axles being appended to the support legs at an approximately 90° angle; and said apertures are angled such that when force is applied to the sling means the support legs lie flat against the bag portion, yet when force is removed from the sling means the support legs pivot not only away from the bag portion but also away from each other, such that the effective area of the base of said tripod is maximized.

11. The devic of claim 9 wherein:

the positioning of the support legs is aided by tensioning means that tend to force the legs to pivot away from the bag toward a stand position.

12. The device of claim 11 wherein:

the tension force is maintained by means of elasticized shock cords.

13. The device of claim 9 wherein:

said sling means includes a plurality of adjustable webbings such that the exact position the bag assumes in carry mode can be altered in order to optimize the weight distribution of the objects in the bag.

14. A golf bag device, comprising:

a bag portion enclosing the clubs and other paraphernalia that the golfer wishes to carry;

a pair of support legs pivotally attached to the bag portion;

sling means for controlling the positioning of the support legs so that the device may be characterized as having a carry mode in which the sling means is pulled taut and the support legs lie flat against the sides of the bag portion, and a rest mode in which the sling means is slack and the support legs extend forward from the bag portion so as to form two legs of a support tripod for the device, the remaining leg of said tripod being formed by the bottom section of the bag portion; and the support legs are pivotally attached to the bag at a pivot element integral with the bag and situated on the circumference of the bag opposite the approximate center of the sling means, said pivot element including a pair of apertures for receiving the legs, said apertures being angled to allow the support legs to swing outward such that the device's effective base is maximized when in the rest position.

15. The dvice of claim 14 wherein:

the positioning of the support legs is aided by tensioning means, said means applying a force that, if unopposed, would tend to urge the support legs away from the bag portion toward the rest position.

16. The device of claim 15 wherein:

said tensioning means is a pair of elasticized shock cords.

17. The device of claim 16 wherein:

tension is achieved by attaching one end of each of said two shock cords at or near the top of the bag portion; and attaching the other ends of said shock cords to the support legs.

18. The device of claim 16 wherein:

the legs each include pivot axle portions adapted to pivotally mate with said apertures in said pivot element.

19. The device of claim 18 wherein:

said pivot axle portions are urged into full engagement with said apertures by the force of said shock cords, with said force being of such magnitude that a user may manually overcome said force in order to remove the leg portions from said engagement when desired.

20. The device of claim 15 wherein:

the sling means, support legs and tensioning means are separate modular elements which may be removed and replaced without altering the remaining elements.

* * * * *